US007086751B2

(12) United States Patent
Clark

(10) Patent No.: US 7,086,751 B2
(45) Date of Patent: Aug. 8, 2006

(54) ILLUMINATED PRODUCT PACKAGING

(75) Inventor: Brett G. Clark, Whites Creek, TN (US)

(73) Assignee: MasonWare Partners, LLC, Nashville, TN (US)

( * ) Notice: Subject to any disclaimer, the term of this patent is extended or adjusted under 35 U.S.C. 154(b) by 93 days.

(21) Appl. No.: 10/607,135

(22) Filed: Jun. 27, 2003

(65) Prior Publication Data

US 2004/0264179 A1 Dec. 30, 2004

(51) Int. Cl.
*F21V 33/00* (2006.01)
*A47F 11/10* (2006.01)

(52) U.S. Cl. ..... 362/154; 362/125; 362/253; 362/360; 40/541

(58) Field of Classification Search ..... 362/154, 362/125, 800, 390, 267, 310, 189, 190, 283, 362/234, 351, 360; 40/541; 428/68
See application file for complete search history.

(56) References Cited

U.S. PATENT DOCUMENTS

| | | | | |
|---|---|---|---|---|
| 5,243,504 | A * | 9/1993 | Sejzer | 362/154 |
| 5,490,047 | A * | 2/1996 | O'Rourke et al. | 473/570 |
| 5,539,626 | A * | 7/1996 | Scholz | 362/249 |
| 5,980,062 | A * | 11/1999 | Bell | 362/184 |
| 6,224,234 | B1 * | 5/2001 | Demmery | 362/156 |
| 6,270,233 | B1 * | 8/2001 | Holland | 362/154 |
| 6,561,690 | B1 | 5/2003 | Balestriero | |
| 6,637,906 | B1 * | 10/2003 | Knoerzer et al. | 362/84 |

* cited by examiner

*Primary Examiner*—Thomas M. Sember
(74) *Attorney, Agent, or Firm*—Banner & Witcoff, Ltd.

(57) ABSTRACT

A product package intended to hold a product for sale. The product package includes one or more light sources disposed therein and configured to direct light through one or more openings in the exterior of the product package, in order to entice customers to purchase the product. Various techniques are used such as diffusing light before letting it exit the product package.

15 Claims, 3 Drawing Sheets

ILLUMINATED PRODUCT PACKAGING

FIELD OF THE INVENTION

Aspects of the present invention are directed generally to product packaging, and more particularly to illumination of product packaging to entice customers to purchase the product.

BACKGROUND

An important consideration in successfully selling a product is to make the product for sale look appealing to and catch the attention of potential retail purchasers. One way to accomplish this is to use colors, shapes, unusual package designs, and lights. For example, certain products have been sold in packaging that has a blinking light disposed on the outside of the package.

It is also important to differentiate a particular product for sale from other products for sale. This has traditionally been done by marking the outside of the package with identifying information such as a trademark and description of the product.

As designers of product packages become more creative, it has become increasingly challenging to distinguish a product from other products.

SUMMARY OF THE INVENTION

Aspects of the present invention are directed to a product package intended to hold a product for sale. The product package includes one or more light sources disposed therein and configured to direct light through one or more openings in the exterior of the product package, in order to entice customers to purchase the product. Various techniques are used such as diffusing light before letting it exit the product package.

According to further aspects of the invention, the light source may not be directly exposed to view by the consumer. Instead, the light source may illuminate a graphical element in the design of the product package, wherein illumination may be from the inside of the product package. The graphical element may consist of one or more openings that may be in the form of a pattern. The openings may be distinctively shaped, and their shapes may depend upon the particular product associated with the product package.

These and other aspects of the invention will become apparent to one of ordinary skill in the art upon a reading of the following description and the claims.

BRIEF DESCRIPTION OF THE DRAWINGS

The foregoing summary of the invention, as well as the following detailed description of illustrative embodiments, is better understood when read in conjunction with the accompanying drawings, which are included by way of example, and not by way of limitation with regard to the claimed invention.

DETAILED DESCRIPTION OF ILLUSTRATIVE EMBODIMENTS

Figure 1:
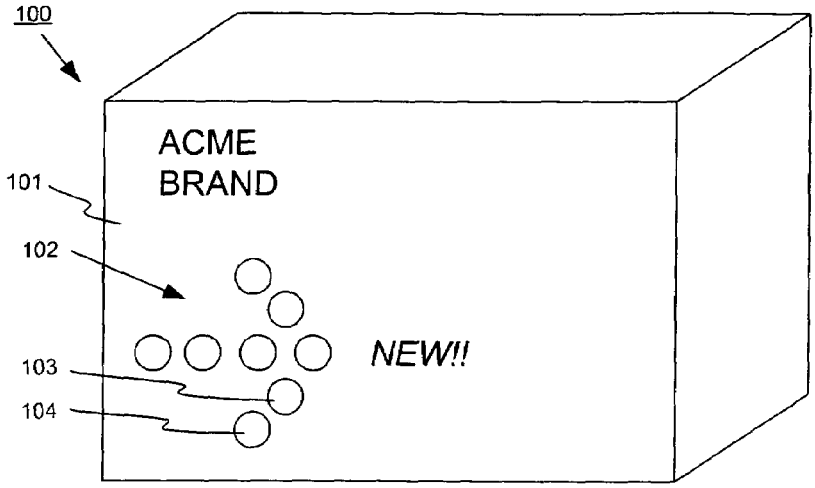
FIG. 1 is a perspective view of an illustrative product package in accordance with at least one aspect of the invention.

Referring to FIG. 1, an illustrative embodiment of a product package 100 is shown. The product package 100 may include an exterior wall 101, which may be a single curved wall or may be divided into a plurality of facets. The facets of the exterior wall 101 may be flat or curved and may be separated from one another by angular or curved edges. The exterior wall 101 may define a three-dimensional volume, within which one or more products may be placed. The exterior wall 101 may partially or fully enclose the three-dimensional volume. Further, the exterior wall 101 may form any shape such as a box, a sphere, a pyramid, a cone, and/or any other geometric or non-geometric shape.

The product(s) may be any type product at all, such as but not limited to electronics, sports equipment, food, medicine, computer products, hardware, clothing, and consumables. The product may be intended for sale in the retail or wholesale market. References to products for "sale" as used broadly herein is intended to include both products that are traded for value, such as for money, as well as products that are given away at no cost to the parties receiving the products.

The exterior wall 101 may be light-permeable or opaque, or a mixture of both. The term "light-permeable material" as used herein includes material that is transparent, light-diffusing, or generally non-opaque. The present example of FIG. 1 assumes that the surface 101 is opaque with the exception of light-permeable portion 102, which may include one or more individual light-permeable elements such as light-permeable elements 103, 104. The exterior wall 101 may be made of any material(s) such as but not limited to cardboard, plastic, glass, paper, and wood. The exterior wall 101 may be made of a single or multiple layers sandwiched together.

The product package 100 may further include one or more openings 103, 104 or other light-permeable portions in the exterior wall 101. The openings 103, 104 may reach fully through the exterior wall 101 through from the outside of the product package 100 to the inside of the product package 100, or only partially into the exterior wall 101. The openings 103, 104 may be of any shape and size, including but not limited to round, square, rectangular, triangular, and/or any other geometric or non-geometric shape. In some embodiments, the openings 103, 104 may be one or more slits or perforations. The openings 103, 104 may be in the shape of symbols imparting meaning, such as but not limited to alphanumeric characters, trademarks, and graphical icons such as stars, insignias, or arrows. A plurality of the openings 103, 104 may be positioned on the exterior wall 101 relative to one another in such a pattern so as to form a shape imparting meaning. In the illustrated embodiment, openings 103, 104, along with other openings, form a light-permeable portion 102, in this case in the shape of an arrow. The light-permeable portion 102 may be embodied by one or more of the openings.

The openings 103, 104 and/or the light-permeable portion 102 may be of a shape that is related to and associated with the product held by the product package 100. For example, where the product is a bicycle, the openings 103, 104 may each be in the shape of a bicycle or a bicycle wheel, and/or the openings 103, 104, and/or other openings may together form a shape of a bicycle or bicycle wheel.

The product package 100 may further include one or more light sources for catching the attention of potential consumers. However, light sources consume power and generally would be expected to account for a substantial portion of the cost of the packaging itself. Therefore, it may be desirable to limit the number of light sources, such as to include only a single light source. Therefore, it may be desirable to have a way of diffusing the light to illuminate a larger area, such as the entire light-permeable portion 102.

Figure 2:
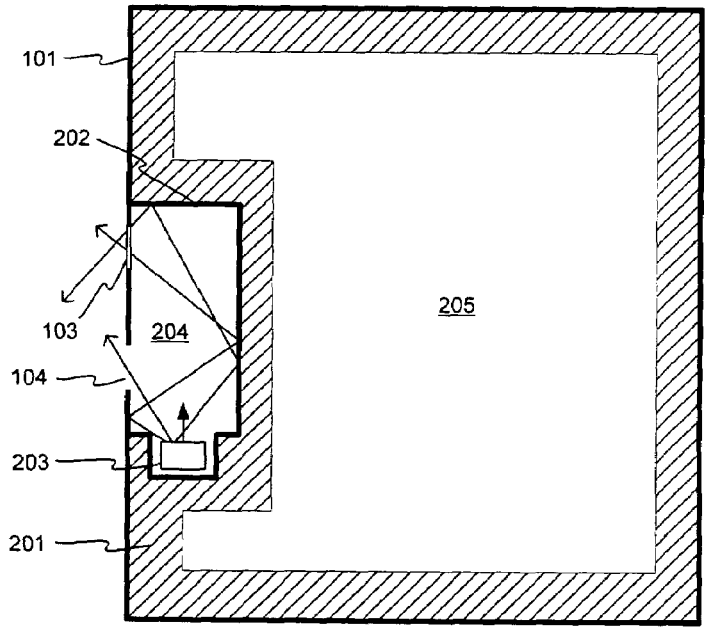
FIGS. 2–6 are side cutaway views of various illustrative embodiments of the product package of FIG. 1 in accordance with at least one aspect of the invention.

Referring to FIG. 2, the product package 100 may further include one or more cavities 204, 205 within the defined three-dimensional volume. The cavities 204, 205 may be partially or fully defined by one or more walls within the three-dimensional volume. For example, wall 202, along with the interior of the exterior wall 101, defines cavities 204 and 205. The wall 202 may be straight, curved, and/or of another shape. The illustrative wall 202 has several corners and extends away from the exterior wall 101, around the cavity 204, and back to the exterior wall 101 again. The product package 100 may further include within the exterior wall 101 packaging filler material 201 that may be used to take up excess volume and/or protect the product from damage and/or movement. The filler 201 may be any material(s) such as but not limited to styrene foam, paper, cardboard, and/or plastic bubble wrap.

The cavities may be used for various purposes, such as for holding the product and/or holding packaging material. Another use for one or more of the cavities is to hold a light source. For example, cavity 205 may partially or entirely hold a product and the filler 201, while cavity 204 may partially or entirely hold a light source 203. The light source 203 may emit light that illuminates some or all of the cavity 204, and that ultimately exits the product package 100 via one or more of the openings 103, 104 or other light-permeable portions of the exterior wall 101. By disposing the light source 203 within the cavity 205, the light source may not be directly viewable by a person standing outside of the product package 100. Instead, indirect light from the light source 203 may be seen being emitted through one or more of the openings 103, 104.

The light source 203 may be any type of light source, such as but not limited to one or more light-emitting diodes (LEDs), incandescent bulbs, or fluorescence bulbs. In one illustrative embodiment, the light source 203 is an ultra-bright, high-efficiency LED. Visible light of one or more colors may be emitted from the light source 203 and may be primarily directed toward one or more of the openings 103, 104, or away from the openings 103, 104. The phrase "primarily directed" as used herein means the average direction in which the light is emitted from the light source 203. Alternatively, the light source 203 may be substantially omni directional by emitting light but not in any particular direction (such as a standard household light bulb does).

In some embodiments, the interior of the cavity 204 may be made reflective. For example, the side of the wall 202 that faces the cavity 204 may have a reflective surface or be layered or coated with a reflective coating or layer. For example, the side of the wall 202 facing the cavity 204 (referred to herein as the inner side of the wall 202) may be lined with metal foil or aluminized plastic, and/or be made of another material such as white closed-cell styrene foam. For example, the inner side of the wall 202 may have a light color such as white, thereby allowing much of the light hitting the inner side of the wall 202 to reflect. The light may reflect off the inner side of the wall 202 in a diffuse or non-diffuse manner. In further embodiments, the wall 202 may be the filler 201 itself.

Thus, at least some of the light emitted from the light source 203 may reflect off the inner side of the wall 202 one or more times, and eventually may pass through one or more of the openings 103, 104 to the exterior of the product package 100. The openings 103, 104 may be empty, partially filled, or completely filled with a solid (e.g., glass or gel) light-permeable material. For example, opening 104 is shown as being empty, such that as light passes through opening 104, it passes through empty space such as through air. On the other hand, opening 103 is shown as filled with a light-permeable material. For example, the light-permeable material that may fill one or more of the openings 103, 104 may be, but is not limited to, plastic and/or glass.

Figure 3:
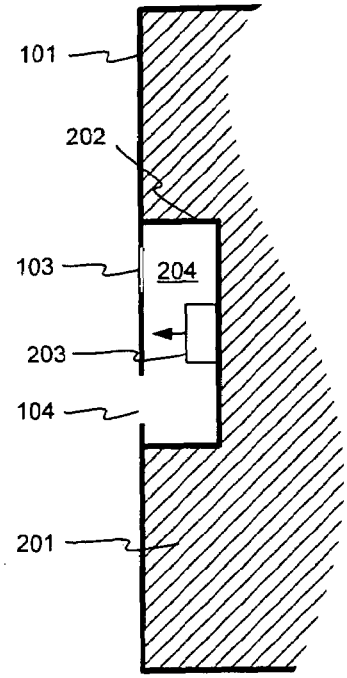
Figure 4:
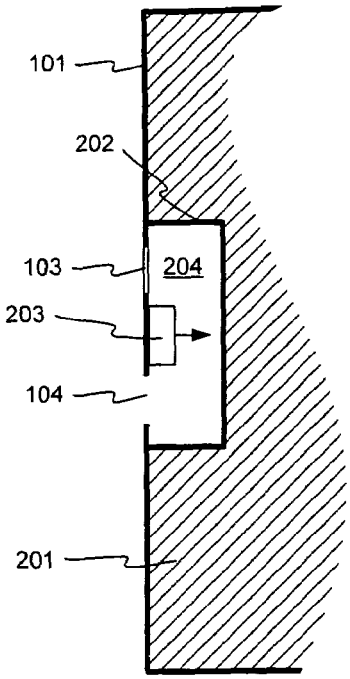
Figure 5:
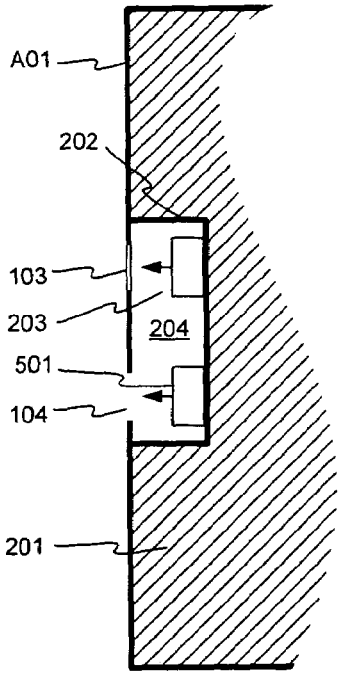

In the embodiment shown in FIG. 2, the light source 203 is directed so as not to primarily direct light toward the openings 103, 104. In this example, the light source 203 is primarily directed approximately parallel to the portion of the exterior wall 101 that defines the cavity 204, as shown by the straight arrow, pointing up in FIG. 2, emitted from the light source 203. However, the light source 203 may be arranged in the cavity 204 in any of a variety of ways. For example referring to FIGS. 3 and 4, the light source 203 may be arranged so as to be primarily directed toward or away from (e.g., normal to) the portion of the surface 103 that defines the cavity 204, as shown by the arrow emitted from the respective light sources. FIG. 5 shows an illustrative embodiment having two separate light sources 203, 501 within the same cavity 204.

Figure 6:
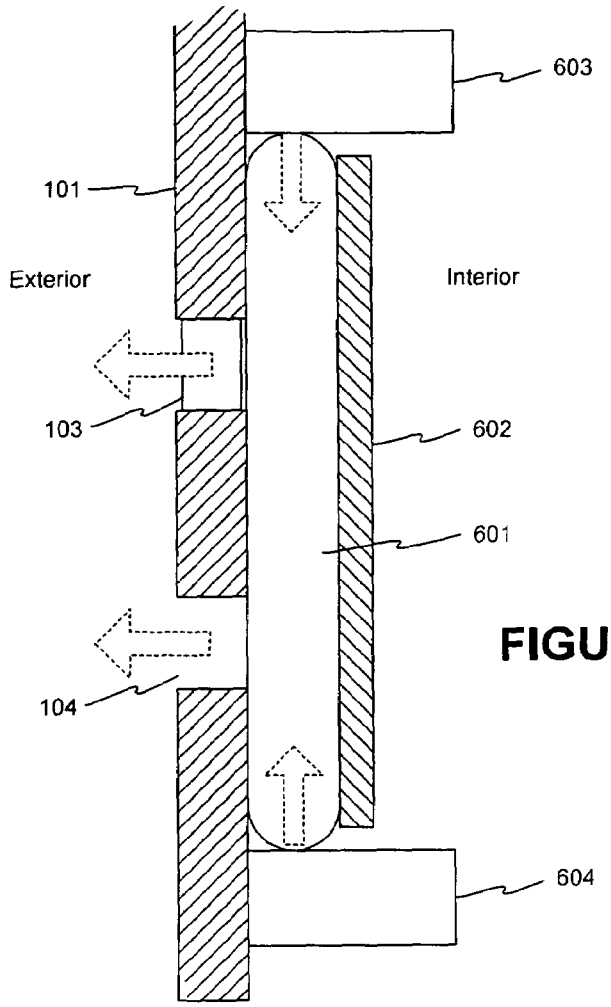

FIG. 6 shows an illustrative further embodiment for providing lighting from the product package 100. One or more light sources 603, 604 may be partially or fully disposed within the interior of the product package 100, i.e., within the volume defined by the exterior wall 101. In some embodiments, the light sources 603, 604 may be attached or otherwise directly or indirectly coupled to the inner side of the exterior wall 101. In other embodiments, the light sources 603, 604 may not be physically coupled with the exterior wall 101. In either case, the light sources 603, 604 may be primarily directed into a light-permeable material 601, as shown by the arrows within the light-permeable material 601. The light-permeable material 601 may be disposed so as to receive at least some of the light from the one or more light sources 603, 604 and transfer at least a portion of the received light out through one or more of the openings 103, 104, as further shown by arrows, thus acting as a light pipe. In some embodiments, like as shown, the light-permeable material 601 may be disposed directly behind one or more of the openings 103, 104. The light-permeable material 601 may be made of any solid material such as plastic, glass, gel, and/or translucent vinyl foam. In some embodiments, the light-permeable material 601 is diffuse. In other embodiments, the light-permeable material 601 is transparent. A potential benefit of using diffuse light-permeable material 601 is that the light emitted from the openings 103, 104 may be more even.

It may be preferable to increase the percentage of the light transmitted into the light-permeable material 601 that ultimately escapes through one or more of the openings 103, 104, instead of being lost into other areas. Thus, a reflective layer or coating 602 may be attached to the light-permeable material 601. The reflective layer or coating 602 may reduce or prevent light from escaping from the light-permeable material 601 into areas other than the openings 103, 104. The reflective layer or coating 602 may be made of any material such as but not limited to metal foil, aluminized plastic, and/or styrene foam, and/or may be painted with or otherwise colored a light color such as white to promote reflection of light.

Figure 7:
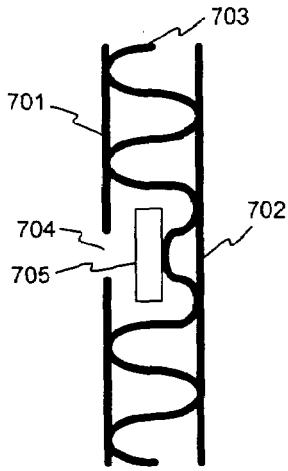
FIG. 7 is a cutaway view of an illustrative cardboard embodiment of an exterior wall in accordance with at least one aspect of the invention.

Referring to FIG. 7, the exterior wall 101 is illustratively shown to be multi-layered. For example, the exterior wall 101 may be made of corrugated cardboard in which two outer paper layers 701, 702 sandwich a corrugated middle layer 703. In such an embodiment, a portion of the middle layer 703 may be cut away to define an interior cavity, into which a light source 705 may be placed. One side 701 of the exterior wall 101 (e.g., the exterior surface of the exterior wall 101) my have an opening 704 for allowing light to escape, similar to the illustrative embodiments previously discussed in connection with FIGS. 2–5. A light pipe may also be inserted inside the cardboard and optically coupled to the light source 705 in a manner similar to the illustrative embodiment discussed in connection with FIG. 6.

Figure 8:
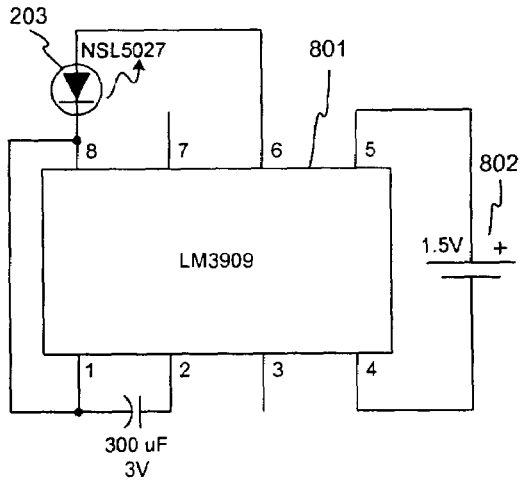
FIG. 8 is a schematic diagram of an illustrative light source driver circuit in accordance with at least one aspect of the invention.

Referring to FIG. 8, a drive circuit may be coupled to one or more light sources, such as light sources 203, 401, 603, and/or 604, for controlling their illumination. In the illustrated embodiment, light source 203 is coupled to a drive circuit that includes an integrated circuit 801. The integrated circuit 801 may be any type of integrated circuit suitable for driving a light source, such as a National Semiconductor LM3909 integrated circuit. The drive circuit may further be powered by a power source such as a battery 802. The drive circuit may be configured to cause the light source 203 to flash periodically, such as once every one to two seconds, or randomly. The flash may be for a very brief period (e.g., twenty milliseconds) or for a longer period. Such flashing may advantageously provide attention-getting brightness while maintaining relatively long battery life. There are a wide variety of known circuits that can cause a light source to flash. Alternatively, the drive circuit may cause the light source 203 to be constantly on. If desired, an insulating strip of material (not shown) may be placed between the battery and one or more of its electrical contact points to conserve battery life. This insulating material may be inserted during the package manufacturing process and later removed, e.g., by a retailer or other vendor, in preparation for putting the packaging containing the product for sale on display.

While exemplary systems and methods as described herein embodying various aspects of the present invention are shown by way of example, it will be understood, of course, that the invention is not limited to these embodiments. Modifications may be made by those skilled in the art, particularly in light of the foregoing teachings. For example, each of the elements of the aforementioned embodiments may be utilized alone or in combination with elements of the other embodiments. In addition, the invention has been defined using the appended claims, however these claims are exemplary in that the invention is intended to include the elements and steps described herein in any combination or sub combination. It will also be appreciated and understood that modifications may be made without departing from the true spirit and scope of the invention.

I claim:

1. A product package intended to hold a product for sale, the product package comprising:

a cardboard exterior wall including a light-permeable portion and an opaque portion, the exterior wall defining an at least substantially enclosed volume sufficient to hold at least a portion of the product; and a light source disposed completely within the volume and configured to generate light within the volume, the light being emitted through the light-permeable portion of the exterior wall.

2. The product package of claim 1, wherein the light-permeable portion includes an opening in the exterior wall.

3. The product package of claim 2, wherein the opening includes a light-permeable solid material disposed therein.

4. The product package of claim 1, wherein the light-permeable portion of the exterior wall includes a plurality of separate light-permeable sub-portions.

5. The product package of claim 1, wherein the light-permeable portion has a shape associated with the product.

6. The product package of claim 1, wherein the light source is configured to blink.

7. A product packaging filler for placement within a rectangular box-shaped volume defined by an exterior wall of a product package, the product package intended to hold a product for sale, the product packaging filler comprising:

a dividing wall configured such that, when the product packaging filler is placed entirely within the rectangular box-shaped volume, the volume is divided by the dividing wall into at least a first volume portion and a second volume portion, the second volume portion intended to hold at least a portion of the product;

a light source disposed such that, when the product packaging filler is placed entirely within the volume, the light source is disposed completely within the volume and is configured to emit light into the first volume portion; and a power source electrically coupled to the light source.

8. The product packaging filler of claim 7, wherein the dividing wall comprises foam.

9. The product packaging filter of claim 7, wherein the dividing wall has a reflective surface on a side of the dividing wall facing the first volume portion.

10. The product packaging filler of claim 7, wherein the first volume portion is hollow, and wherein the light from the light source is emitted into the hollow first volume portion.

11. A product for sale and its package, comprising:

a product;

an exterior wall including a plurality of separate openings, the exterior wall defining an at least substantially enclosed hollow volume, the volume including a first volume portion and a second hollow volume portion physically divided from the first volume portion, the first volume portion holding at least a portion of the product; and a light source configured to direct light inside the second volume portion, the light being emitted into the second hollow volume portion and through all of the plurality of openings.

12. A product for sale and its package, comprising:

a product;

a cardboard exterior wall including a plurality of separate light-permeable portions and an opaque portion, the exterior wall defining an at least substantially enclosed volume holding at least a portion of the product; and a light source disposed completely within the volume and configured to generate light within a hollow portion of the volume, the light being emitted through the plurality of light-permeable portions of the exterior wall.

13. A product package intended to hold a product for sale, the product package comprising:

an cardboard external portion including an opaque portion and a light-permeable portion, the external portion defining a volume sufficient to at hold at least a portion of the product;

a blinking light source configured to indirectly illuminate the light-permeable portion such that light exits the product package through the light-permeable portion; and a battery, disposed in the volume, configured to provide power to the light source.

14. A product package intended to hold a product for sale, the product package comprising:

an exterior wall including an opening, the exterior wall defining an at least substantially enclosed volume, the volume including a first volume portion and a second volume portion physically divided from the first volume portion, the first volume portion being sufficient to hold at least a portion of the product; and a light source configured to direct light inside the second volume portion, the light being emitted through the opening, wherein the opening has a shape associated with the product, and wherein the exterior wall is made of cardboard.

15. A product package intended to hold a product for sale, the product package comprising:

an exterior wall including an opening, the exterior wall defining an at least substantially enclosed volume, the volume including a first volume portion and a second volume portion physically divided from the first volume portion, the first volume portion being sufficient to hold at least a portion of the product; and a light source configured to direct light inside the second volume portion, the light being emitted through the opening, wherein the opening has a shape associated with the product, and wherein the exterior wall is made of paper.

* * * * *